US006018829A

United States Patent [19]

Rosenquist

[11] Patent Number: 6,018,829

[45] Date of Patent: Feb. 1, 2000

[54] SUPPORT STRUCTURE FOR BEDS AND THE LIKE

[76] Inventor: Terry L. Rosenquist, 835 N. Hewett St., Hastings, Nebr. 68901

[21] Appl. No.: 09/159,361

[22] Filed: Sep. 23, 1998

[51] Int. Cl.[7] ..... A47C 19/00; A47C 19/20

[52] U.S. Cl. ..... 5/9.1; 5/8

[58] Field of Search ..... 5/2.1, 9.1, 8; 105/316; 114/192; 244/118.6, 118.5; 182/128; 211/189

[56] References Cited

U.S. PATENT DOCUMENTS 4,312,086 1/1982 Bianco ..... 5/9.1
5,150,484 9/1992 Whitten, Jr. ..... 5/9.1
5,483,707 1/1996 Meyer et al. ..... 5/9.1
5,701,616 12/1997 Rosenquist ..... 5/8

*Primary Examiner*—Michael F. Trettel
*Assistant Examiner*—Fredrick Corley
*Attorney, Agent, or Firm*—Zarley, McKee, Thomte Voorhees & Sease; Dennis L. Thomte

[57] ABSTRACT

A support structure for beds and the like is described comprising a plurality of components which are easily secured together in a minimum amount of time. The scaffold or support is comprised of a pair of floor cross supports, four vertical legs, a pair of lower cross supports, a pair of left end supports, a pair of right end supports, bed cross pieces, a pair of ceiling beams, and a pair of upper cross supports. When assembled, the floor space beneath the support structure is available for use.

11 Claims, 5 Drawing Sheets

SUPPORT STRUCTURE FOR BEDS AND THE LIKE

BACKGROUND OF THE INVENTION

1. Technical Field

The present invention is directed to a load-bearing scaffold and more particularly to a load-bearing scaffold or support structure for beds and the like which provide substantially one hundred percent unobstructed floor space in sleeping quarters and garages.

2. Description of the Prior Art

Load-bearing scaffolds are well known in the construction arts. Such scaffolds are generally adapted for supporting workmen, construction equipment, and building materials.

Also known are bunks and berths adapted to provide sleeping accommodations for passengers, military personnel, students, or small children. These apparatus are often adapted to be supported from poles anchored to the floor and ceiling of a room. For example, apparatus of this general species are disclosed by Lein, U.S. Pat. No. 665,535; Rodrigues, U.S. Pat. No. 958,895; Gosso, U.S. Pat. No. 1,325,320; and Gosso, U.S. Pat. No. 1,089,545.

Also known to the art are bunks or berths adapted to be supported by anchoring the bunk or berth to a wall. For example, apparatus of this general species are disclosed by Lein, U.S. Pat. No. 669,175; Dowling, U.S. Pat. No. 822,592; Rodrigues, U.S. Pat. No. 860,941; Gumm, U.S. Pat. No. 1,001,946; Thompson, et al., U.S. Pat. No. 3,215,387; Coomes, U.S. Pat. No. 3,858,254; and Trexler, Jr., et al., U.S. Pat. No. 4,084,276.

Inventions of this type are unsuitable for the present objects since their installation requires that they become room fixtures. Additionally, such bunks or berths necessarily require the dedication of otherwise useful floor space.

Freestanding bunk beds are also known to the bunk and berth art. Examples of this type of bed may be found disclosed by Lein, U.S. Pat. No. 631,962; Anderson, U.S. Pat. No. 1,195,637; Weaver, U.S. Pat. No. 1,253,549; and Janson, et al., U.S. Pat. No. 1,349,962.

U.S. Pat. No. 5,701,616 provided a support structure for beds and the like which derived at least some of its support from the interior surfaces of a room. Although the device of U.S. Pat. No. 5,701,616 represented an advance in the art, the instant invention is believed to be an advance thereover due to the fewer components parts, ease of assembly, and superior strength.

3. Objects of the Invention

Many educational institutions provide dormitories in order to accommodate students who are required to live on campus. Dormitories are generally multistory buildings having a central elevator and stairway corridor. On either side of the central area is a hallway having a plurality of small rooms located on either side of the hallway. These small rooms generally do not have bathrooms.

Each room has a small closet and is usually furnished with two single beds, two desks, two lamps, two chairs, and a dresser or bureau. Even though each room contains a minimal amount of furniture, the rooms are small, and space is at a premium.

Since these rooms are small and sparse, it is difficult for two people to live comfortably within the room. This is true since most dorm rooms lack sufficient space to maintain a stereo, television, small refrigerator, or to store a bicycle and the like.

Students desiring a more livable environment often remove their beds or make the existing two single beds into a lower and upper berth bunk bed. With the same goal in mind, students also replace their beds with futon mattresses.

The primary object of the present invention is to provide an improved load-bearing scaffold capable of supporting beds or items to be stored while providing substantially one hundred percent unobstructed floor space therebelow.

Another object of the present invention is to provide a load-bearing scaffold that does not require the scaffold to be attached to the room infrastructure or superstructure.

Another object of the present invention is to provide a load-bearing scaffold that will not damage room surfaces.

Another object of the present invention is to provide a load-bearing scaffold that is easy to assembly and disassemble.

Another object of the present invention is to provide a load-bearing scaffold that is safe to use and durable in construction.

Another object of the present invention is to provide a load-bearing scaffold that is low in cost and easy to manufacture.

Another object of the present invention is to provide an adjustable load-bearing scaffold adapted to fit in any size room.

Another object of the present invention is to provide a load-bearing scaffold that frees existing floor space.

Finally, another object of the present invention is to provide a load-bearing scaffold capable of supporting beds, desks, shelves, and the like.

These and other objects will be obvious to those skilled in the art.

SUMMARY OF THE INVENTION

The present invention provides a load-bearing scaffold adapted to support items to be stored or beds while providing one hundred percent unobstructed floor space therebelow. The scaffold of this invention is comprised of a plurality of components parts which are easily secured together in a minimum amount of time. Essentially, the scaffold is comprised of a pair of floor cross supports, four vertical legs, a pair of lower cross supports, a pair of left end supports, a pair of right end supports, bed cross pieces, a pair of ceiling beams, and a pair of upper cross supports.

DESCRIPTION OF THE PREFERRED EMBODIMENT

Figure 3:
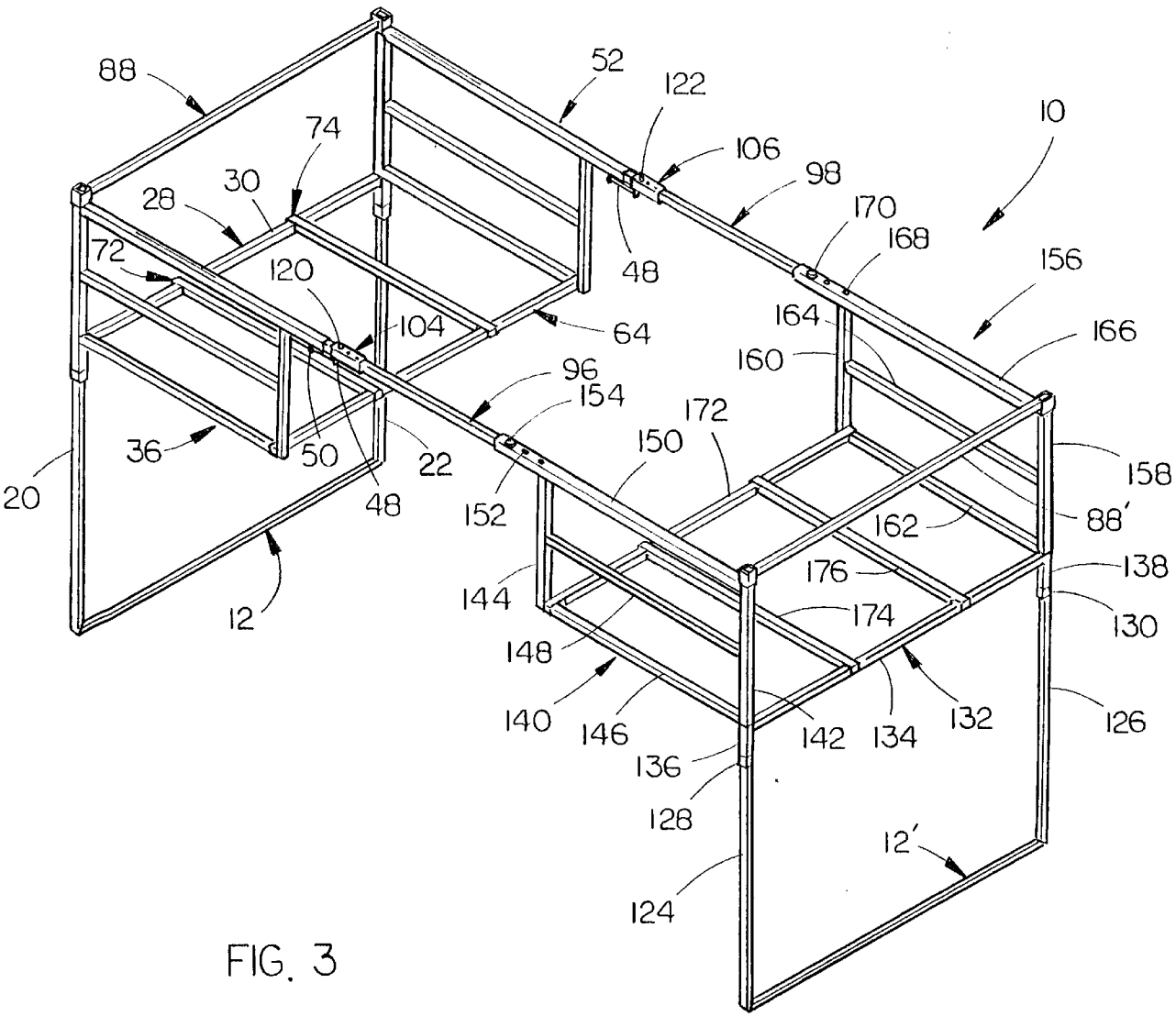
FIG. 3 is a perspective view of the assembled scaffold.
Figure 4:
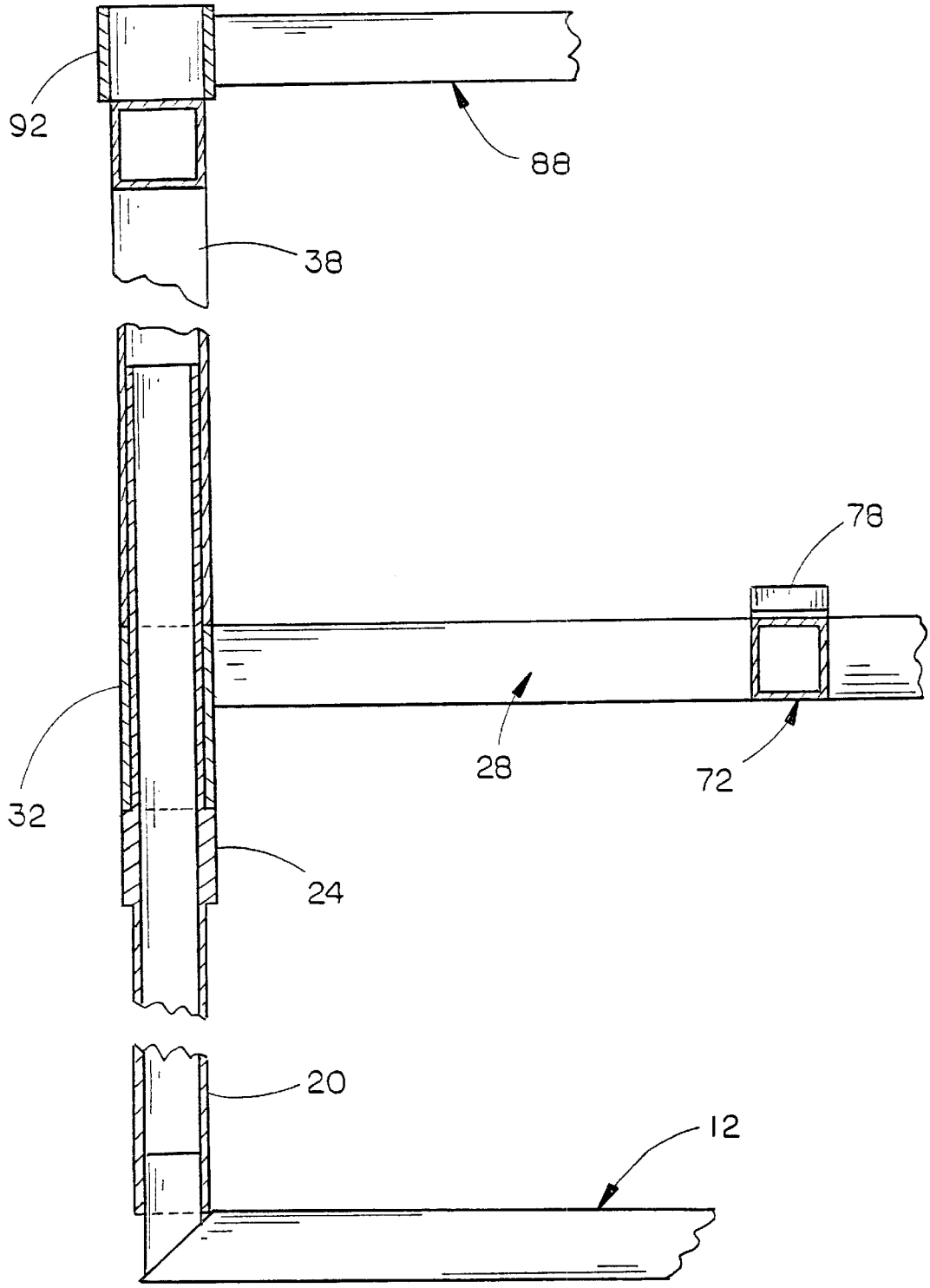
FIG. 4 is a sectional view illustrating a portion of the scaffold.
Figure 5:
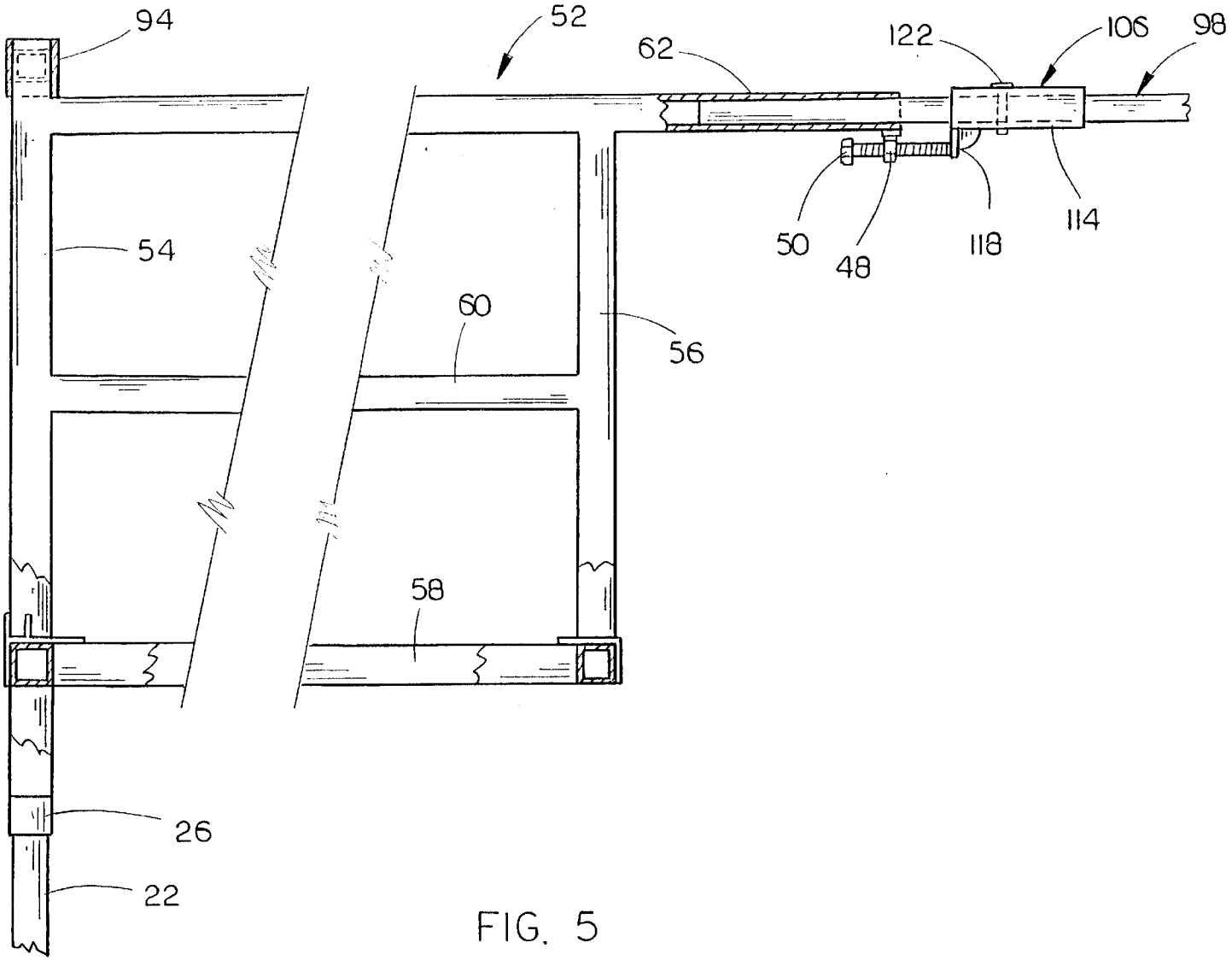
FIG. 5 is a partial sectional view illustrating certain components of the invention.

The assembled scaffold of this invention is referred to generally by the reference numeral 10 (FIG. 3). The numerals 12 and 12' refer to identical floor cross supports. Since floor cross supports 12 and 12' are identical, only floor cross support 12 will be described in detail with "'" indicating identical structure on floor cross support 12'. Floor cross support 12 includes an elongated tube 14 having pegs 16 and 18 secured to the opposite ends thereof which extend upwardly therefrom. Vertical legs 20 and 22 which are hollow tubular members have their lower ends received by the pegs 16 and 18, respectively. Square tubes 24 and 26 are welded to the vertical legs 20 and 22 below the upper ends thereof. The numeral 28 refers to a lower cross piece comprised of an elongated tubular member 30 having hollow tubes 32 and 34 secured to the opposite ends thereof which extend downwardly therefrom, as seen in the drawings. Tubes 32 and 34 are slidably mounted on the upper ends of the vertical legs 20 and 22, respectively. End support 36 is mounted on the upper end of vertical leg 20 and is comprised of an outer tubular post 38, inner tubular post 40, lower tubular member 42 which is secured to and which extends between the lower ends of posts 38 and 40, intermediate tubular member 44 and upper tubular member 46. The opposite ends of tubular member 44 are welded to the inner and outer posts 38 and 40. The outer end of upper tubular member 46 is welded to the upper end of outer post 38. As seen in the drawings, the upper end of inner post 40 is welded to the underside of upper tubular member 46. As also seen in the drawings, the inner end of upper tubular member 46 is provided with a nut 48 welded thereto having adjustment bolt 50 threadably mounted therein.

End support 52 is positioned on the upper end of vertical leg 22 and is identical to end support 36. End support 52 includes an outer post 54 which is mounted on the upper end of vertical leg 22, inner post 56, lower tubular member 58, intermediate tubular member 60, and upper tubular member 62. The inner end of upper tubular member 62 has a nut 48' (identical to nut 48) welded thereto which threadably receives bolt 50' (identical to bolt 50) therein.

The numeral 64 refers to a bed end piece comprising an elongated tubular member 66 having hooks 68 and 70 provided at the outer ends thereof which are adapted to receive the lower tubular members 42 and 58, respectively, as illustrated in the drawings. Bed cross pieces 72 and 74 extend between bed end piece 64 and tubular member 30 of lower cross piece 28. Bed cross piece 72 includes an elongated tubular member 76 having hooks 78 and 80 secured to the opposite ends thereof which are adapted to receive tubular member 30 and tubular member 66, respectively. Similarly, bed cross piece 74 includes an elongated tubular member 82 having hooks 84 and 86 at the opposite ends thereof which are adapted to receive the tubular members 30 and 66, respectively.

Figure 1:
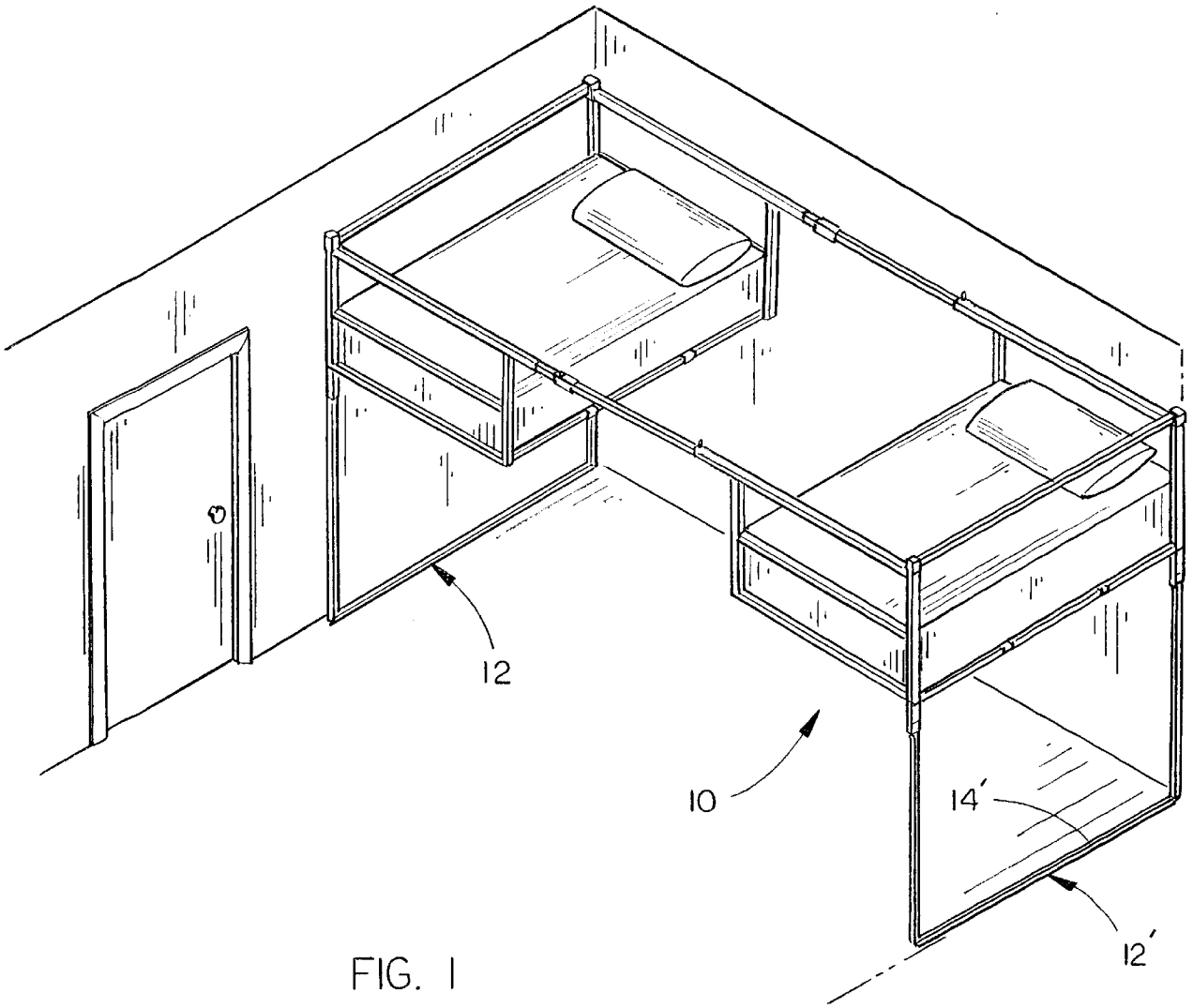
FIG. 1 is a perspective view of the scaffold of this invention in its assembled state.
Figure 2:
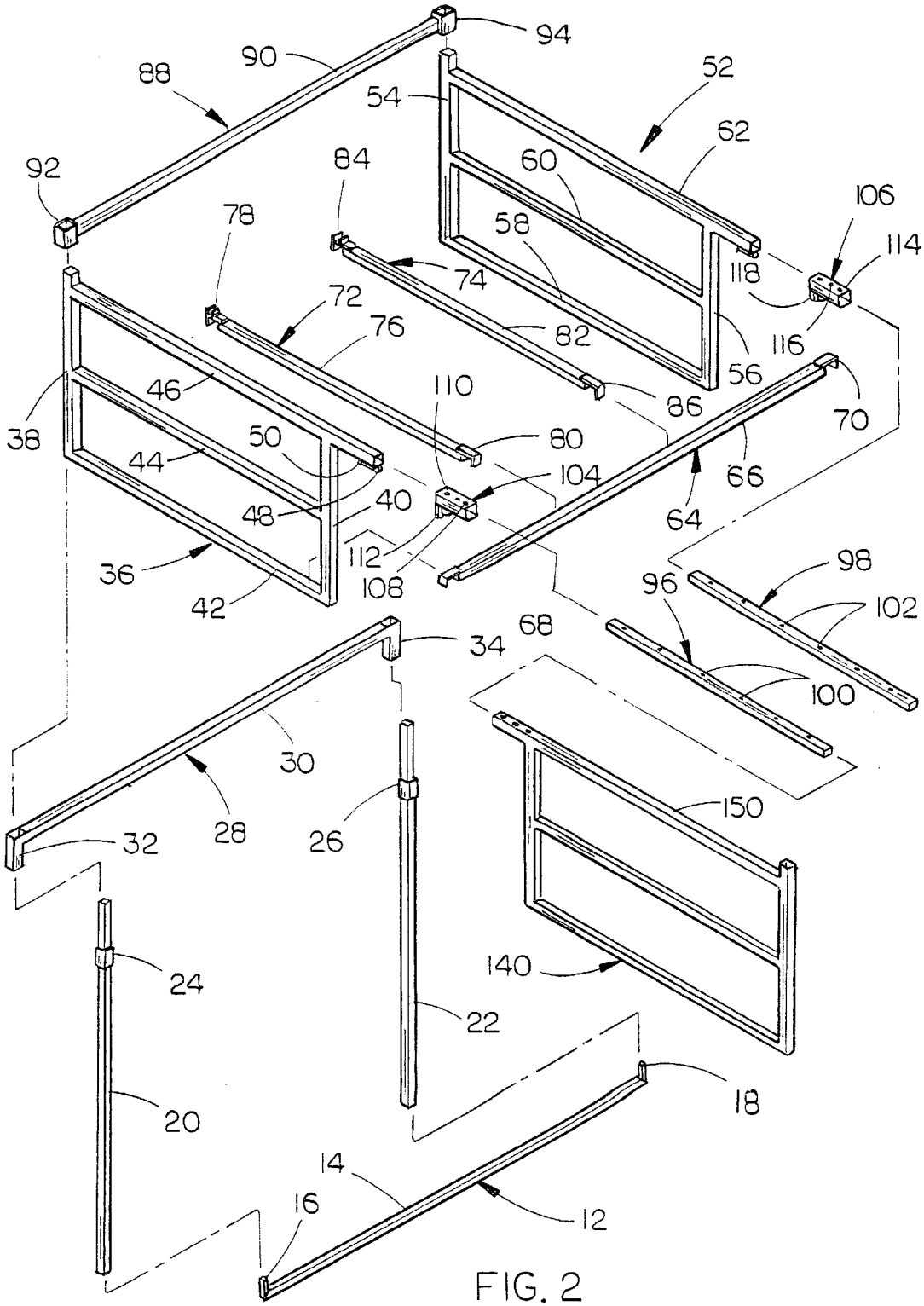
FIG. 2 is an exploded perspective view of a portion of the scaffold.

Upper cross support 88 comprises an elongated tubular member 90 having sleeves 92 and 94 at the opposite ends thereof which are adapted to be received on the upper ends of the posts 38 and 54, respectively, as best seen in FIG. 2. Ceiling beams 96 and 98 are provided and have a plurality of spaced-apart openings 100 and 102 formed therein, respectively. Adjustable wedges 104 and 106 are slidably received on one end of the tubular members 96 and 98, respectively, as also seen in the drawings. Adjustable wedge 104 includes a hollow stub 108 having a plurality of spaced-apart openings 110 formed therein. A downwardly extending bracket 112 is provided at one end of the stub 108, as seen in the drawings. Adjustable wedge 106 includes a hollow stub 114 having a plurality of spaced-apart openings 116 formed therein. A downwardly extending bracket 118 is provided at one end of the stub 114.

The adjustable wedges 104 and 106 are selectively slidably secured to the ceiling beams 96 and 98, respectively, by means of pins 120 and 122, respectively.

The bolts 50 and 50' are threadably moved with respect to nuts 48 and 48', respectively, so that the ends of the bolts 50 and 50' engage the brackets 112 and 118 of the adjustable wedges 104 and 106 to lend strength and stability to the assembly.

Referring now to the other end of the scaffold or bed support of this invention, a pair of vertical legs 124 and 126 extend upwardly from the pegs at the opposite ends of the floor cross support 12' and have square tubes 128 and 130 welded thereto below the upper ends thereof. The numeral 132 refers to a lower cross piece comprised of an elongated tubular member 134 having hollow tubes 136 and 138 secured to the opposite ends thereof which extend downwardly therefrom, as seen in the drawings. Tubes 136 and 138 are slidably mounted on the upper ends of vertical legs 124 and 126, respectively, and are limited in their downward movement by the square tubes 128 and 130.

End support 140 is mounted on the upper end of vertical leg 124 and is comprised of an outer tubular post 142, inner tubular post 144, lower tubular member 146 which is secured to and which extends between the lower ends of posts 142 and 144, intermediate tubular member 148, and upper tubular member 150. The opposite ends of lower tubular member 146 are welded to the posts 142 and 144. The opposite ends of intermediate tubular member 148 are also welded to the posts 142 and 144. Further, the upper tubular member 150 is welded to the posts 142 and 144. The inner end of tubular member 150 is provided with a plurality of openings 152 adapted to have a pin 154 extending therethrough.

End support 156 is positioned on the upper end of vertical leg 126 and is identical to end support 140. End support 156 includes an outer post 158 which is mounted on the upper end of vertical leg 126, inner post 160, lower tubular member 162, intermediate tubular member 164, and upper tubular member 166. The inner end of tubular member 166 is provided with a plurality of openings 168 formed therein adapted to receive pin 170 therein.

Bed end piece 172 is identical to bed end piece 64 and is secured to and extends between the tubular members 146 and 162, as seen in the drawings. Bed cross pieces 174 and 176 are identical to bed cross pieces 72 and 74 and are secured to and extend between the tubular members 134 and 172, as seen in FIG. 3.

The scaffold 10 of this invention is assembled as follows. The floor cross supports 12 and 12' are placed opposite each other against the wall where the bed will be placed lengthways. Lower cross support 28 is placed over the top of the vertical legs 20 and 22. The bottom ends of the vertical legs 20 and 22 are then placed over the pegs 16 and 18 at the ends of the floor cross support 12. The lower cross support 132 is placed over the tops of the vertical legs 124 and 126. The lower ends of the vertical legs 124 and 126 are then placed over the upstanding pegs at the opposite ends of the floor cross support 12'.

End supports 36 and 140 are then placed on the floor opposite to each other with their bases approximately one inch or less from the adjacent wall. The adjustable wedge 104 is then slidably mounted on the ceiling beam 96. Ceiling beam 96, with holes 102 facing upwardly, is then inserted all the way inside the upper tubular member 46 of end piece 36. The opposite end of ceiling beam 96 is then inserted into the upper tubular member 150 of end piece 140. Pin 154 is then inserted downwardly through one of the openings 152 and into one of the openings 100 in ceiling beam 96. It should be noted that the adjustable wedge 104 is secured to the ceiling beam 96 as close to the end of the bolt 50 as possible. The assembled end piece 36, ceiling beam 96 and end piece 140 is then placed over the upper ends of the vertical legs 20 and 124, respectively. The end piece 52, adjustable wedge 106, ceiling beam 98 and end piece 156 is then assembled in an identical fashion to that just described.

The upper cross support 88 is then positioned on the upper ends of the posts 38 and 54, respectively, as illustrated in FIG. 2. Upper cross support 88' is then mounted on the upper ends of the posts 142 and 158, respectively. While pushing up on the center of the ceiling beam 96, the bolt 48 is threadably moved against the bracket 112 on the adjustable wedge 104 until the bolt 48 cannot be tightened any further by hand. The bolt 48' is likewise tightened while upward pressure is placed on the ceiling beam 98. The members 64 and 172 are then installed as are the members 72, 74, 174 and 176.

The support or scaffold of this invention assembles in approximately ten minutes with only twenty-one parts, without tools.

The construction of the scaffold, through the design of the same, is extremely strong, since it is much like a truss structure. Further, the floor space beneath the scaffold or bed support is devoid of any obstructions which enables the floor space to be maximized.

Thus, it can been seen that the invention accomplishes at least all of its stated objectives.

I claim:

1. A load-bearing scaffold adapted to be supported on the floor of a room and to support articles thereon, comprising:

first and second elongated floor cross supports having opposite ends;

said opposite ends of said floor cross supports having upstanding members provided thereon;

first and second vertical legs, having upper and lower ends, removably mounted on said upstanding members of said first floor cross support and extending upwardly therefrom;

third and fourth vertical legs, having upper and lower ends, removably mounted on said upstanding members of said second floor cross support and extending upwardly therefrom;

a first lower cross support removably mounted on the upper ends of said first and second vertical legs and extend therebetween;

a second lower cross support removably mounted on the upper ends of said third and fourth vertical legs and extending therebetween;

first, second, third and fourth end supports each having an upper end, a lower end, an inner end and an outer end;

the lower outer ends of said first, second, third and fourth end supports being removably mounted on said upper ends of said first, second, third and fourth vertical legs, respectively;

said first and third end supports extending toward one another;

said second and fourth end supports extending towards one another;

a first upper cross support removably mounted on the upper outer ends of said first and second end supports and extending therebetween;

a second upper cross support removably mounted on the upper outer ends of said third and fourth end supports and extending therebetween;

a first ceiling beam selectively adjustably secured to the upper inner ends of said first and third end supports and extending therebetween;

and a second ceiling beam selectively adjustably secured to the upper inner ends of said second and fourth end supports and extending therebetween.

2. The scaffold of claim 1 wherein each of said first, second, third and fourth end supports includes inner and outer vertical posts and further includes at least an elongated lower member, an elongated intermediate member and an elongated upper member which are secured to and which extend between said inner and outer vertical posts.

3. The scaffold of claim 2 wherein an elongated first bed end piece is removably secured to and extends between said lower members of said first and second end supports adjacent the inner ends thereof and wherein an elongated second end piece is removably secured to and extends between said lower members of said third and fourth end supports.

4. The scaffold of claim 3 wherein at least one bed cross piece is removably secured to said first lower cross support and said first bed end piece and wherein at least one bed cross piece is removably secured to said second lower cross support and said second bed end piece.

5. The scaffold of claim 1 wherein an adjustable wedge is provided on each of said ceiling beams.

6. A load-bearing scaffold adapted to be supported on the floor of a room and to support articles thereon, comprising:

first and second elongated floor cross supports having opposite ends;

said opposite ends of said floor cross supports having upstanding members provided thereon;

first and second vertical legs, having upper and lower ends, removably mounted on said upstanding members of said first floor cross support and extending upwardly therefrom;

third and fourth vertical legs, having upper and lower ends, removably mounted on said upstanding members of said second floor cross support and extending upwardly therefrom;

a first lower cross support removably mounted on the upper ends of said first and second vertical legs and extending therebetween;

a second lower cross support removably mounted on the upper ends of said third and fourth vertical legs and extending therebetween;

first, second, third and fourth end supports each having an upper end, a lower end, an inner end and an outer end;

the lower outer ends of said first, second, third and fourth end supports being removably mounted on said upper ends of said first, second, third and fourth vertical legs, respectively;

said first and third end supports extending toward one another;

said second and fourth end supports extending towards one another;

a first upper cross support removably mounted on the upper outer ends of said first and second end supports and extending therebetween;

a second upper cross support removably mounted on the upper outer ends of said third and fourth end supports and extending therebetween;

a first ceiling beam selectively removably secured to the upper inner ends of said first and third end supports and extending therebetween;

and a second ceiling beam selectively removably secured to the upper inner ends of said second and fourth end supports and extending therebetween.

7. The scaffold of claim 6 wherein each of said first, second, third and fourth end supports includes inner and outer vertical posts and further includes at least an elongated lower member, an elongated intermediate member and an elongated upper member which are secured to and which extend between said inner and outer vertical posts.

8. The scaffold of claim 7 wherein an elongated first bed end piece is removably secured to and extends between said lower members of said first and second end supports adjacent the inner ends thereof and wherein an elongated second end piece is removably secured to and extends between said lower members of said third and fourth end supports.

9. The scaffold of claim 8 wherein at least one bed cross piece is removably secured to said first lower cross support and said first bed end piece and wherein at least one bed cross piece is removably secured to said second lower cross support and said second bed end piece.

10. The scaffold of claim 6 wherein an adjustable wedge is provided on each of said ceiling beams.

11. The scaffold of claim 6 wherein said first ceiling beam is selectively adjustably secured to at least the upper inner end of one of said first and third end supports and wherein said second ceiling beam is selectively adjustably secured to at least the upper inner end of one of said second and fourth end supports.

* * * * *